US011246385B2

(12) United States Patent
Soukenik, IV et al.

(10) Patent No.: US 11,246,385 B2
(45) Date of Patent: Feb. 15, 2022

(54) ANATOMICALLY CORRECT JEWELRY RING ASSEMBLY

(71) Applicant: Joseph and Jack Soukenik Partnership, Mantua, OH (US)

(72) Inventors: Joseph J. Soukenik, IV, Mantua, OH (US); Jack Harrison Soukenik, South Euclid, OH (US)

(73) Assignee: JOSEPH AND JACK SOUKENIK PARTNERSHIP, Mantua, OH (US)

( * ) Notice: Subject to any disclaimer, the term of this patent is extended or adjusted under 35 U.S.C. 154(b) by 0 days.

(21) Appl. No.: 16/881,702

(22) Filed: May 22, 2020

(65) Prior Publication Data

US 2020/0367614 A1 Nov. 26, 2020

Related U.S. Application Data

(60) Provisional application No. 62/852,803, filed on May 24, 2019.

(51) Int. Cl.

| | |
|---|---|
| ***A44C 9/00*** | (2006.01) |
| ***A44C 27/00*** | (2006.01) |
| ***A44C 17/02*** | (2006.01) |

(52) U.S. Cl.

CPC ..... *A44C 9/00* (2013.01); *A44C 17/02* (2013.01)

(58) Field of Classification Search

CPC ..... A44C 9/00; A44C 17/02; A44C 27/00
USPC ..... 29/8; 63/15
See application file for complete search history.

(56) References Cited

U.S. PATENT DOCUMENTS

| | | | | | |
|---|---|---|---|---|---|
| 1,210,963 | A | * | 1/1917 | Mascher | G01B 5/12 33/544.4 |
| 2,558,271 | A | * | 6/1951 | Rothenberg | B21D 53/44 29/8 |
| 3,193,941 | A | * | 7/1965 | Hoffman | A44C 9/02 33/514.1 |
| 3,360,959 | A | * | 1/1968 | Schechter | A44C 9/00 63/15.6 |
| 4,043,145 | A | * | 8/1977 | Chervin | A44C 9/00 63/15 |
| 4,964,222 | A | * | 10/1990 | Keener | G01B 3/30 29/8 |
| 5,353,513 | A | * | 10/1994 | Round | G01B 3/34 33/514.1 |
| D384,588 | S | * | 10/1997 | Napier | D10/65 |
| D522,902 | S | * | 6/2006 | Kaplan | D11/26 |
| D604,193 | S | * | 11/2009 | Kohl | D11/26 |

(Continued)

*Primary Examiner* — Jack W Lavinder
(74) *Attorney, Agent, or Firm* — Sandberg Phoenix and von Gontard

(57) ABSTRACT

A method of manufacturing, tool for manufacturing and an improved ring design and configuration having an improved anatomically correct internal shank with an internal surface having a plurality of spaced apart inwardly projecting internal structures and recessed surfaces configured for enabling the ring to pass over the knuckle at a reduced ring diameter, and having an internal portion of the ring transformed from the standard and long traditional circular shape to one that compliments the shape of the knuckle over which the ring traverses, and having a narrower diameter when placed on the ring bearing back portion of an appendage of a wearer providing an improved fit and comfort of the ring during use by the wearer.

22 Claims, 5 Drawing Sheets

(56) References Cited

U.S. PATENT DOCUMENTS

| | | | | |
|---|---|---|---|---|
| 2007/0137250 | A1* | 6/2007 | Kohl | A44C 9/00 63/15.6 |
| 2008/0168800 | A1* | 7/2008 | Nisguretsky | A44C 9/0053 63/27 |
| 2015/0296932 | A1* | 10/2015 | Escobar | A44C 9/02 63/15 |

* cited by examiner

ANATOMICALLY CORRECT JEWELRY RING ASSEMBLY

CROSS-REFERENCE TO RELATED APPLICATIONS

This application claims the benefit of U.S. Provisional Application No. 62/852,803, filed on May 24, 2019.

FIELD

The present disclosure relates to jewelry and, more specifically, to a ring to be worn on an appendage and a method of manufacturing thereof.

BACKGROUND

The statements in this section merely provide background information related to the present disclosure and may not constitute prior art.

Jewelry rings that are worn on a person's fingers or toes (referred herein as an appendage) have always been designed and manufactured to be a circle. Rings having a circular shape are often considered to be so fashioned to symbolize endless love. Rings having a circular shape are created, manufactured and sold so that a ring for a particular person having an internal circular diameter dimensioned to clear the knuckle of the appendage on which the ring is to be worn and then rest on the back portion of the appendage. However, diameter required to clear the knuckle has a larger diameter than the desired diameter of the ring wearing portion of the appendage, and as such, the internal ring bearing diameter of the rings are oversized for such ring wearing portion, after the ring clears the larger knuckle.

Further, another dilemma lies in the fact that the width of the knuckle joint flairs out or is horizontally oblong which is so dimensioned for receiving and securing the next rounded bone and joint on the appendage like a socket. The knuckle joint is not circular or round, and as such, the size of the ring for a particular appendage of a person have always been established based on what an internal diameter that is necessary for a circular inside shaped ring to clear the knuckle to move the ring into the ring wearing portion thereof, which is often independent and quite smaller than the ring bearing diameter for a comfortable fit of the ring on back ring bearing portion of the appendage. However, once the ring clears the larger and horizontally oblong knuckle, the ring is oversized for such ring wearing portion. As it is oversized for the normal ring wearer portion of the appendage, the internal ring bearing diameter of the ring is too large for the ring wearing portion and therefore there is a tendency for the ring to roll on the on the ring wearing portion of the appendage when worn.

Prior efforts to address this problem have included various ways to reduce the space on the inside of the ring. These have included efforts that have included various external or post manufacturer methods to provide a better fit to the back ring bearing portion of the appendage which reduces the ring rolling such as: a) placement or use of sizing beads; b) placement of a sizing arch; 3) increasing the ring by 1 ring size and then soldering a butterfly or "U" spring on the inside diameter of the ring; and 4) using various forms of arthritic/hinged shanks. However, each of these prior efforts is often costly and time consuming to customize for each user's ring and appendage on which it will be placed and worn. As such, there is a need for an improved design and method of manufacturing a jewelry ring that is dimensioned and sized sufficiently to fit over the larger oblong shaped knuckle but that also has a ring bearing diameter that is more suitable for the size for back ring wearing portion of the appendage without being oversized or being too large thereby allowing the ring to roll thereon.

SUMMARY

The inventors hereof have succeeded at designing an improved ring design and configuration having an improved anatomically correct internal shank that maintains the original unaltered exterior design of the ring. The inside portion of the ring is transformed from the standard and long traditional substantially circular shape of all prior rings to one that compliments the shape of the knuckle over which the ring must traverse in getting the ring placed on the ring bearing back portion of the appendage and that once placed thereon has a ring bearing diameter sizing that is more appropriate for the back ring bearing portion of the appendage. Through such presently presented new an anatomically correct ring design, once placed over the knuckle and on the ring bearing back portion of the appendage, the anatomically correct ring has a smaller ring bearing diameter thereby providing for a better fit and less ring roll. The inventors of this new improved ring design believe that this new design is both novel and nonobvious over prior ring designs as they have no knowledge or any similar ring design or changes to the prior art ring designs.

Furthermore, as the improved anatomically correct ring has a new internal surface as created by the inventors, the inventors have created new improved tools and method of measuring the size of the new improved an anatomically correct ring design to provide for a consistent sizing of the improved ring as compared to prior sizing tools that would inaccurately size the new improved design.

According to one aspect, an improved anatomically correct jewelry ring has a main body with an outer shape and an outer surface defining an outer perimeter. The main body has an internal surface wall defining an orifice having a center, with the orifice being configured for receiving an appendage of a wearer. The main body has a width from a first side to a second side, a top having an outer surface that is configured for receiving or mounting of a jewelry fixture, a bottom that is on the opposing side of the main body from the top outer surface, and a right side and a left side. The ring further has a plurality of spaced apart internal structures on the internal surface wall that inwardly project with each adjacent pair of internal structures defining a recessed surface there between. Each inwardly projecting internal structure has an internal structure surface and an internal structure height of inward projection from the adjacent recessed surface and defines a first internal diameter. Each inward projection has an internal structure length along the internal perimeter surface wall defining the recessed surface. Each of the plurality of recessed surfaces between the internal structures defining a second internal diameter that is greater than the first internal diameter In another aspect, a method of manufacturing an anatomically correct jewelry includes forming a main body having an outer shape with an outer surface defining an outer perimeter including a top, a bottom and two opposing sides. Forming an internal surface wall defining an orifice having a center. The orifice being formed for receiving an appendage of a wearer. The orifice being formed with a defined width from a first side to a second side. The main body being formed having a top wherein the outer surface of the top is configured for receiving or mounting of a jewelry fixture, a bottom that is on the opposing side of the main body from the top outer surface and a right side and left side. The method further including forming a plurality of spaced apart internal structures on the internal surface wall that project inwardly. The forming of each internal structure includes forming a surface for each internal structure and an internal structure height of the inward projection that is a height above an adjacent recessed surface. The forming of the internal structures defining a first internal diameter. The forming of each internal structure including forming a length along the internal perimeter surface wall. The method further includes forming between each adjacent pair of internal structures a recessed surface. The forming including forming between two opposing recessed surfaces a second internal diameter that is greater than the first internal diameter.

In some aspects, the method can also include determining the first internal diameter as a distance required for the ring to pass over a knuckle of the appendage, and determining the internal structure height from the determined first internal diameter. The method can also include determining a length for each internal structure wherein the forming includes forming the plurality of internal structures using the determined lengths of each internal structure. The method can also include determining the first internal diameter using a ring sizer shaped with internal structures that project inwardly from an internal surface of the ring sizer and that has two different internal diameters, a first internal diameter defined between opposing internal structures and a second internal diameter that is greater than the first internal diameter. The method can further include determining the first internal diameter using a mandrel having a tapered elongated body with an outer surface having a plurality of different scaled diameters along the length of the elongated body and having a plurality of spaced apart longitudinal internal cavities formed thereon. The method can include use of the longitudinal cavities on the mandrel for receiving inwardly projecting internal structures of a ring placed on the mandrel with the recessed portions of the internal surface contacting the outer surface of the mandrel.

According to another aspect, a ring sizing mandrel configured for size selection of an improved an anatomically correct ring as disclosed herein is also disclosed. The improved sizing mandrel has a plurality of outer surface cavities for receiving a plurality of internally projecting internal structures for the sizing of the improved ring to fit over the knuckle and having the outer surface of the sizing mandrel being dimensioned for sizing of the ring bearing portion of the intended appendage.

According to another aspect, a set of ring sizers for initial sizing selection of an improved an anatomically correct ring for an appendage of a intended user where each ring sizer having a plurality of outer surface cavities for receiving a plurality of internally projecting internal structures for the sizing of the improved ring to fit over the knuckle and with the outer surface of the sizing mandrel being dimensioned for sizing of the ring bearing portion of the intended finger or toe.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

FIG. 1, which includes

FIG. 2, which includes

FIG. 5, which includes

It should be understood that throughout the drawings, corresponding reference numerals indicate like or corresponding parts and features.

DETAILED DESCRIPTION

Figure 1A:
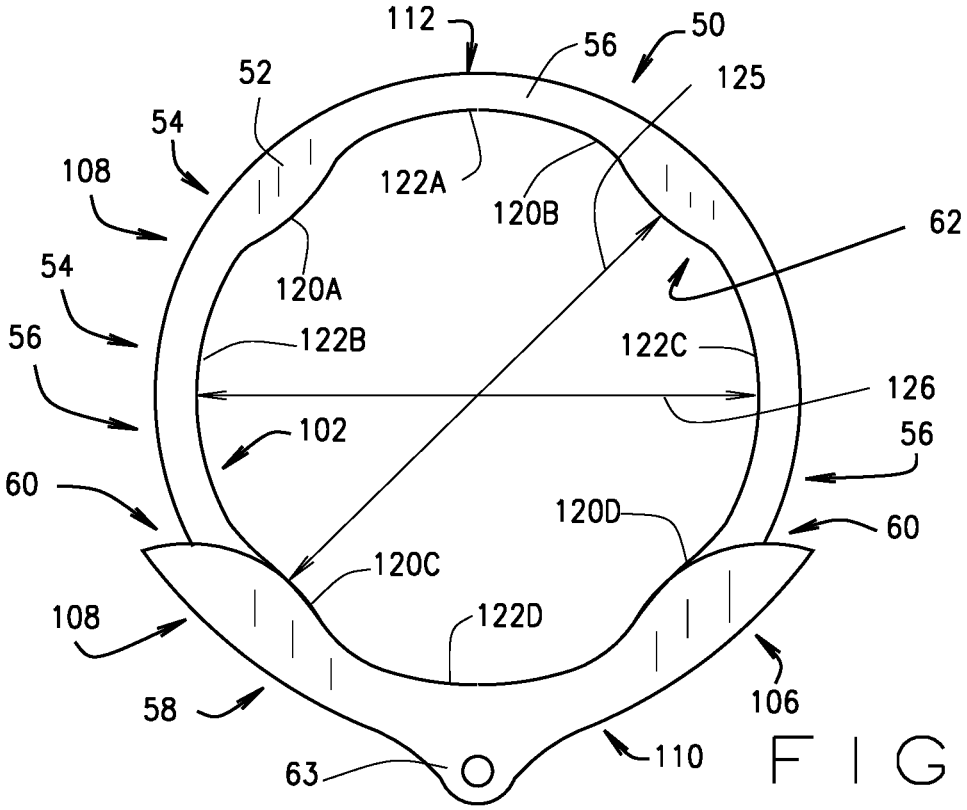
FIGS. 1A and 1B, illustrate a first manufacture of an improved jewelry ring with FIG. 1A being an end view of a first hand-carved wax model for manufacturing an improved ring and FIG. 1B being the finished manufactured first improved jewelry ring formed therefrom, according to one exemplary embodiment of the disclosure.

The following description is merely exemplary in nature and is not intended to limit the present disclosure or the disclosure's applications or uses.

As will be described herein, various embodiments of an improved anatomically correct shanked ring can be incorporated into the casting of all rings to improve the fit and comfort of wearing the improved ring and that minimizes the turning and rolling of the ring on the back ring bearing portion of the finger or toe. As will be described, the anatomically correct ring is configured with an interior of the ring being modified from prior ring configurations and designs, without impacting the exterior of a ring and therefore the outward appearance of rings are not changed or impacted. As such, the improved anatomically correct ring design can be implemented with any outer ring design that can keep its original or intended form and design including a band design or a design with a prominent center gemstone or diamond such as a solitaire, but providing such ring with improved fit and comfort.

The presently disclosed improved anatomically improved and correct ring, rather than merely having an internal circular shape, or having an adapter or beads or other means, including the often used tape, is configured as described herein, to adapt to, and in some instances follow, the shape of the knuckle to allow passage of the ring over the knuckle while providing a more appropriate fit to the ring bearing back portion of the finger or toe. The presently described non-circular inside portion of the improved and anatomically correct ring includes predetermined internally extending internal structures, such as arches, interspaced along the inside circumference of the ring creating internal recessed surfaces. By doing so, each improved ring can be resized to more appropriately fit the ring bearer back portion of the finger or toe on which the ring is to be worn while still enabling the ring to pass over the knuckle. In some cases, by having at least one of the internal ring designs as described herein, the ring can have a reduced size of a half size, and in other cases, less and in some cases more, than a one half reduction in size as compared to an internal circle shaped ring. By having an internal surface shape that is not merely round but that compliments the shape of the knuckle as provided by the internally extending interspaced internal structures and recessed surfaces on the inside circumference of the ring, the ring can not only be placed and traverse over the knuckle as the recessed surfaces can allow passage of the larger knuckle, but the internal structures can provide for improved sizing and comfort, and less rotation or roll of the ring on the ring bearer portion on the back of the finger or toe.

With the presently disclosed improved ring, only the inside portion of the ring is transformed from a traditional circle to one that compliments the shape of a knuckle. In some embodiments, the disclosed improved ring is configured to have two or more, and in some embodiments, four, internal structures of equal height and length spaced apart by predetermined length recessed surfaces, located on the inside circumference of the ring, and is some embodiments each can be placed an equidistance from one another. In such an exemplary embodiment, there can be one internal structure located in each quadrant of the interior of the ring that is incorporated into the internal surface of the ring during a casting of the ring and creating four equally spaced internal recessed surfaces. The width of each internal structure can be equal to the width of the ring design for the ring bearing back portion of the finger or toe, which provides for an improved comfort for the wearer of the ring and decreased rolling or movement while being retained on the ring bearing back portion of the finger or toe.

In one exemplary embodiment, the improved ring is configured to have four internal structures each with a height or apex of about 0.25 mm above the internal recessed surface of the ring that defines the interspaced recessed surfaces. In other embodiments, depending on the sizes of the particular knuckle and ring bearer back portion of the intended finger or toe as compared to the size and shape of the knuckle over which the ring must pass, the apex of each of the four internal structures can be about 0.50 mm. In such embodiments, in many cases these internal structures enable the ring to be a half size smaller than a traditional circular interior ring. The internal structures in this embodiment enable the one half size smaller ring (such as a size 5½ ring rather than a circular size 6 ring) while still allowing the ring to fit over the knuckle. However as being smaller than the traditional round ring that has an increased first internal diameter necessary to fit or traverse over the knuckle, once the improved ring traverses over the knuckle, the improved ring has an second internal diameter that is smaller than the first internal diameter and more accurately fits the small diameter of the ring bearing back portion of the appendage. In this manner, in some embodiments, a one half smaller ring will have a second small diameter that is sized to more closely fit the ring bearing back portion of the finger, which is less likely to have excess size that enables the ring to rotate or roll on the ring bearing portion. Of course as one of ordinary art will understand after reviewing this disclosure, the number of internal structures, their location, and their shape and height, and length within the internal surface of the ring that forms the first internal diameter, relative to the internal recessed surfaces defined between each adjacent pair of internal structures, can vary and can be customized for design and production of the ring for particular user knuckles and ring bearer back portions of the user's finger or toe on which a particular ring is to be worn.

Further, while it has been described that all internal structures have the same internal arch apex and have the same length, in some embodiments, the improved ring can have internal structures having different apex heights and can have different lengths and therefore different lengths of the internal recessed surfaces. The selection of the height of the internal structures and the length of the internal structures, and therefore the internal recessed surfaces, can be customized for the particular finger or toe based on the size and shape of the knuckle to provide for customized movement of the ring over the knuckle through the created internal recessed surfaces, and to more accurately size the ring for the back portion of the ring bearing finger or toe as provided by the internal structures.

In other embodiments, the inward projecting number, height, and length of the internal structures, and therefore the internal recessed surfaces, of the improved ring can easily be adjusted prior to the casting of the ring to accommodate particular user's fingers or toes. For instance, variations on the height of one or more or all of the internal structures can be adjusted where for a particular user, there is a greater knuckle-to-finger variance as provided in the exemplary sizing chart of Table 1 attached hereto.

Further, in some embodiments, the internal surface of the ring can be non-circular shaped. For instance, in some embodiments, one or more portions of the internal recessed surfaces of the ring that are located between the internal structures can be thicker or thinner than other portions located between other internal structures. By way of one example, the portion of the internal surface of the ring that is located between the two internal structures that are located on the bottom right and left of the knuckle and finger can have a narrower or reduced thickness as compared to those interior ring portions that are on either side on the top of the finger. Further, in some embodiments, based on the shape of the intended knuckle, that length and apex height of the internal structures located on the bottom right and left of the knuckle can be shorter in length and shorter in apex height as compared to those internal ring portions that are on either side on the top of the finger.

Figure 1B:
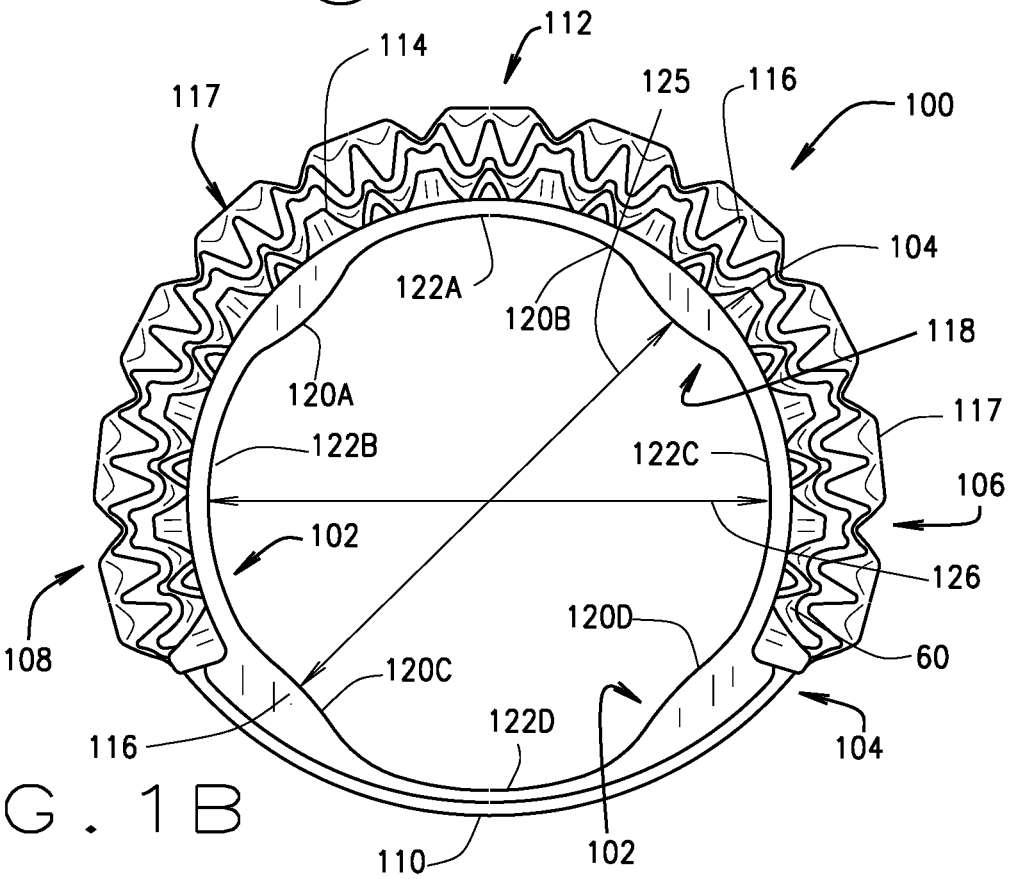

By way of one exemplary embodiment of an improved ring, FIG. 1A illustrates an exemplary wax ring model for making an improved anatomically correct interior shaped ring as subsequently produced as shown in FIG. 1B. As shown in this example, in FIG. 1A the ring model 50 has a model body 52 that is generally round in shape as with traditional rings. The outer surface 54 of the body 52 defining the outer periphery of the model 50 is generally round on the right side 106 and left side 108 as well as on the top 112 in this example. Of course, often the top 112 can be configured to include a mount, which is not shown in this embodiment. As shown here, the bottom 110 includes a bottom position mount support 58 having opposing mounting ends 60 for supporting a top mounted ring fixture such as one for mounting gem feature (not shown in FIG. 1A but shown in FIG. 1B). In most embodiments, these gem mounting fixtures are generally on the outer surface 54 wherein the inside surface 62 of the model body 52 is round or substantially round or oval. However, unlike prior ring models, the improved ring model 50 has an internal surface 62 has a plurality of internal structures 120, shown as 120A, 120B, 120C, 120D, each of which is separated by recessed surfaces 122, shown as 122A, 122B, 122C, 122D. As shown in this example, each internal structure 120 are arched inward towards the center of the ring model body 52, which is inward from the recessed surfaces 122. Each internal structure 120 has a height that extends inward above the two internal surfaces 122 positioned on either side of each internal structure 120. As shown, in this example embodiment of a model body 52, there are four internal structures 120 and four internal recessed surfaces 122. The location of the internal structures 120 will be discussed further with reference to the design of the improved ring in the discussion of FIGS. 3 and 4 below. As noted, the ring model body 52 includes in this embodiment a mount support 58 that is located on the bottom 110 of the ring. As shown in this example, the ring model body 52 is in a rough stage of development and includes a holding feature 63 which was formed by the carver or creator of the ring model body 52. The holding feature 63 is removed before production of the ring from this ring model body 52.

FIG. 1B illustrates an exemplary embodiment of an anatomically correct improved ring 100 that could be created from the ring model body 52 of FIG. 1A. As shown in this example, the improved ring 100 has a ring body 102 has a generally round outer in shape as with traditional rings. The outer surface 104 of the ring 100 is generally round on the right and left sides 106, 108 as well as on the bottom 110. These are generally on the outer surface 104 the traditional band design. Similarly, also on the outer surface 104 is the top 112 that includes a ring design portion 114, which can include a gemstone mount 116 positioned at the top center, or two more such mounts 116. As shown in this finished example, the gems 117 are position in a gemstone mount 16 that is mounted on the upper outer surface 104 and on the upper side of the bottom position mount support 116 that was formed from the model fixture and the two formed mounting ends 60. The internal surface 118 is formed having a plurality of internal structures 120, shown as arches 120A, 120B, 120C, 120D, and between each set of these internal structures 120 are internal recessed surfaces 122 shown as 122A, 122B, 122C, 122D, each of which were formed from the corresponding features of model body 52 of the ring model 50. As shown in this example, the internal structures 120 are spaced apart and have an internally arched design with an apex 131 having a height A that is inwardly above the two recessed surfaces 122 on either side of each internal structure 120.

Figure 2A:
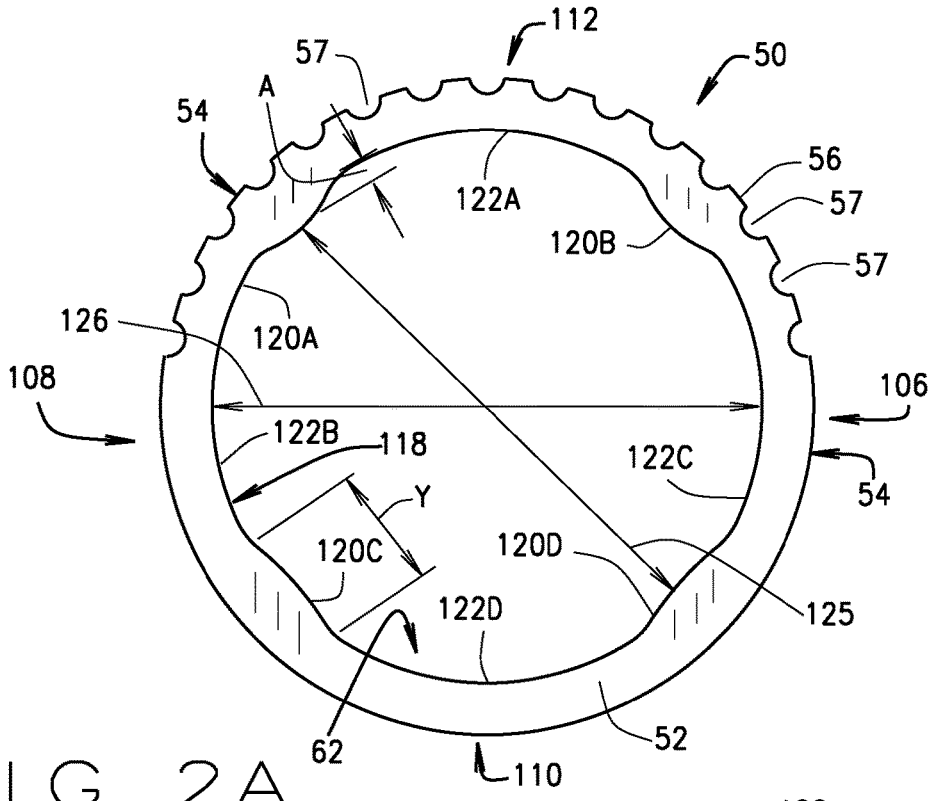
FIGS. 2A and 2B, illustrate a second manufacture of an improved jewelry ring with FIG. 2A being an end view of a second hand-carved wax model for manufacturing an improved ring and FIG. 2B being the finished manufactured second improved jewelry ring formed therefrom, according to another exemplary embodiment of the disclosure.
Figure 2B:
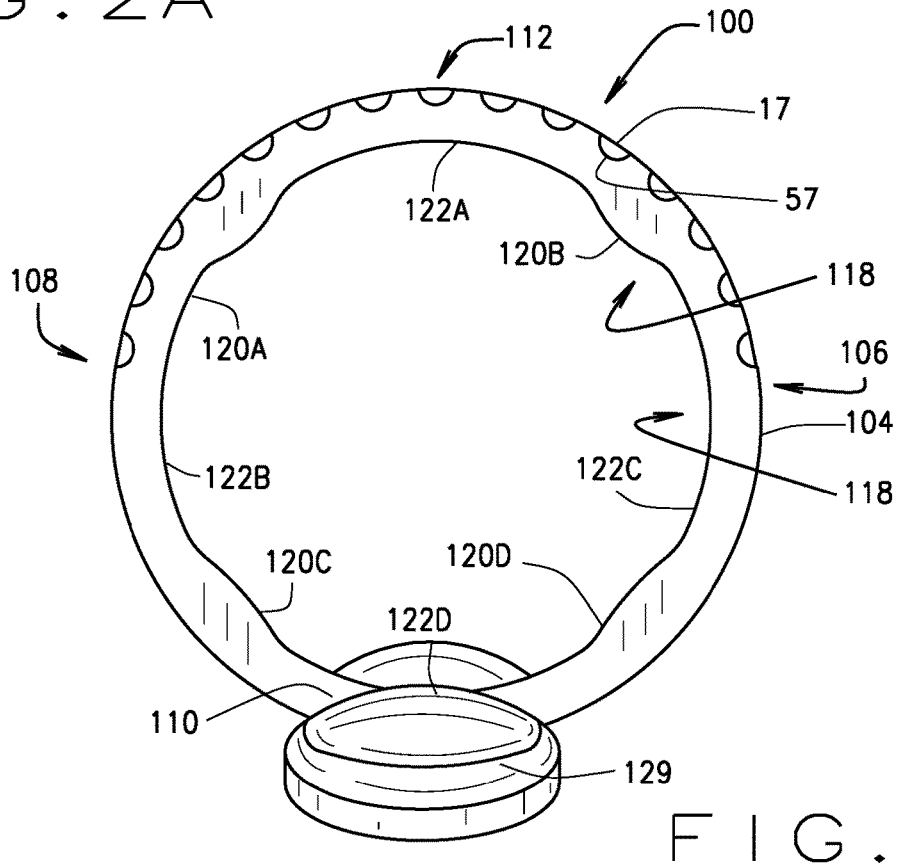

FIG. 2 includes FIG. 2A which is a second exemplary embodiment of a ring model 50, and FIG. 2B is a ring 100 that could be manufactured from the ring model 50 of FIG. 2A. In this example, the ring 100 is more of a traditional round ring body that is formed from ring model body 52 and having four internal structures 120 that are formed as arches 120, shown as 120A, 120B, 120C, 120D, and between each set of these internal structures 120 are internal surfaces 122 shown as 122A, 122B, 122C, 122D. Each internal structure 120 has an arch shape with a length along the internal surface 118 and has an internal structure maximum height A, typically located at an apex 131 for an arch shaped internal structure 120. In this example, two opposing internal structures 120 define a first internal diameter 125, such as shown between internal structure 120A and internal structure 120D. Between each pair of adjacent internal structures 120, a recessed surface 122 is formed along the internal surface 118. Between each opposing recessed surface 122, a second internal diameter 126 is defined, such as shown between recessed surfaces 122A and 122D. As the internal structures has an upper surface defining a height A that is above that of the recessed surfaces 122, the first internal diameter 125 is less than the second internal diameter 126. Further, in this embodiment, the top 112 of the body includes a plurality of gem mounting cavities 57 formed on the outer surface 56. After the ring 100 is manufactured by such means as lost wax investment casting process as known in the art, the ring 100 is formed having the anatomically correct designed internal surface 118 which is not round by that has two different length diameters. FIG. 2B shows that the gems 117 have been placed in the cavities 57 as formed in the ring model 57. Also shown, a ring holder 129 which is well known and not a part of the presently claimed invention.

Figure 3:
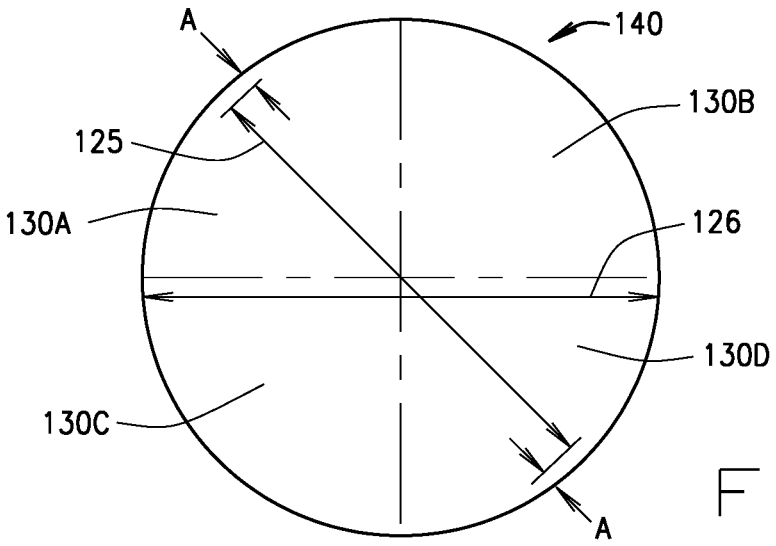
FIG. 3 illustrates a diagram showing the graphical layout for designing an improved ring according to one exemplary embodiment of the present disclosure.
Figure 4:
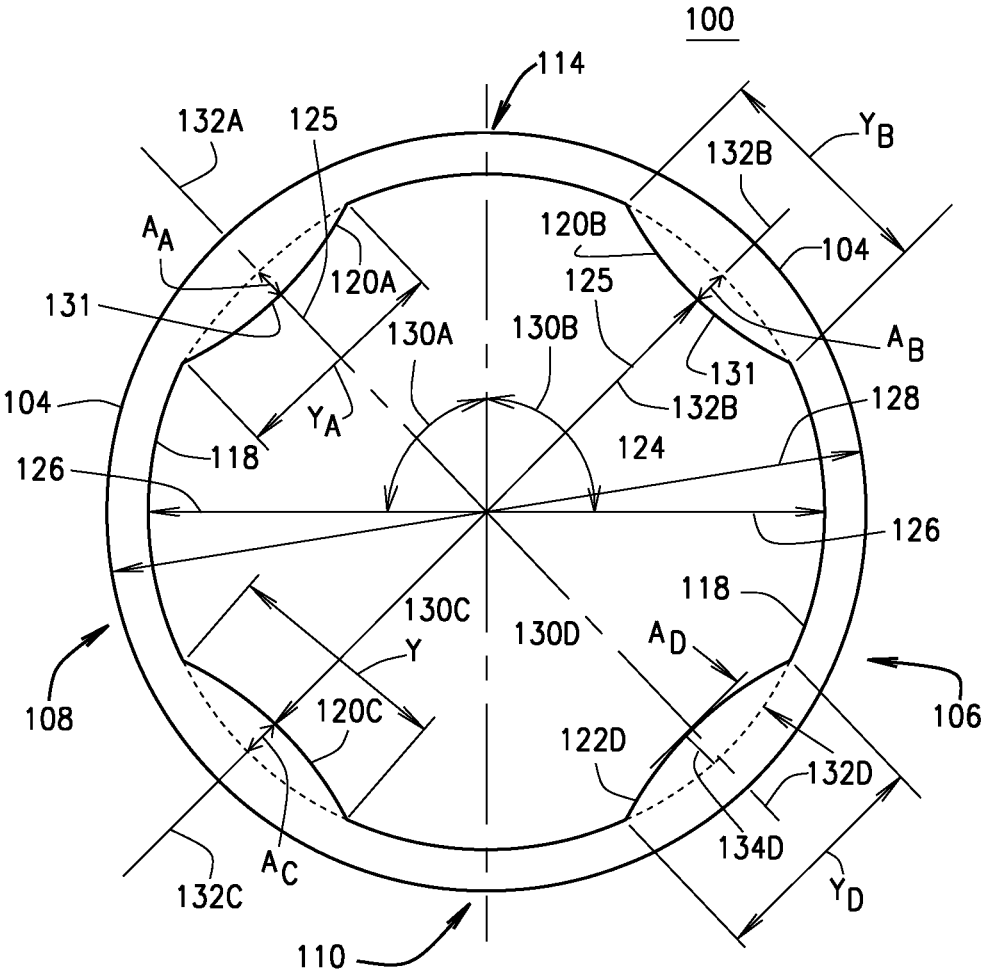
FIG. 4 is a graphical layout illustrating the internal surface features and their design, sizing, layout, and shaping for an improved ring according to one exemplary embodiment of the present disclosure.

FIG. 3 is an illustrated drawing of the location of exemplary placement of the internal structures, which can include internally projecting arches and their apex or location of maximum height that defines the first smaller internal diameter wherein the height thereof is above the recessed surfaces that define the larger second internal diameter. As shown in FIG. 4, an apex of each internal structure 120 (such as one shaped like an arch) can have a height, by way of example, of about 0.25 mm that forms the first internal diameter which is less than the inside diameter defined by the distance between two opposing internal recessed surfaces 112. The height of each or two or more internal structures that define the first smaller diameter can vary and be customized for the intended appendage and often can range from about 0.1 mm to about 0.5 mm or more. In some embodiments, the height can be up to about 0.75 mm, thought greater heights are possible and within the scope of the present disclosure. The location of the internal structures 120, such as arches, is shown in FIGS. 3 and 4 to be equally spaced apart in this example. FIG. Some of the criteria for selection of the height, number, length and number of internal structures for the anatomically correct improved anatomically correct ring 100, includes, but is not limited to this combination or to only this combination such as minimizing turning during manufacture, providing a more accurate compliment to the knuckle, providing for the ring to clear the knuckle while still fitting comfortably to the back portion of the appendage, having internally projecting internal structures 120 such as arches that are rounded or that have rounded ends, and having a fill width of the shank.

Further, by way of some examples, the internal structures 120 can be configured to create the first internal diameter 125 as well as the recessed surfaces 122 resulting thereby based on one or more formula that may be suitable for the particular user or the particular appendage. This can include design and therefore configuration of the internal structures 120 and the recessed surfaces 122, the first internal diameter 125, and the second internal diameter 126, respectively, where such a formula provides for the design of the internal structures 120 as to their height, length, and shape, which inherently also defines the first internal diameter 125, the recessed surfaces 122 and the second internal diameter 126 on the internal surface 118. The length of an internal structure 120, such as an arch, can vary but be formulated as described above in some embodiments. An example for a size 6 ring is also shown that provides one example of the length, shape and placement of the internal structures 120, with four internal arches being the internal structures 120, and the internal recessed surfaces 122 defined there between.

As one example of such formulation of the dimensioning and sizing of structures 122 that define the internal surfaces 122, in formula terms: x is the second inside diameter 126 that is determined to be desired ring bearer diameter of the appendage, c is the circumference, $\pi$ times x is equal to c, y is the length of each internal structure 120 assuming each has the same length in this example, and A is the apex or height of the internal structures 120 that define the first inside diameter 125, than:

$$c/8=y \quad (1)$$

By way of one example, if the A is 0.25 mm, then:

$$c/8=A \quad (2)$$

By way of one example, for a ring 100 having a size 6, and the second internal diameter 126 of the ring bearer diameter is 16.51 mm, then the circumference c is 16.51×3.147 or 51.87 mm. The length of each internal structure 120 ion along the internal surface 118 is 51.87/8 or 6.48 mm. The apex or height of the internal structure 120 is 0.25 mm polished and the apex height A (or maximum height of each internal structure 120) where A is 51.87 mm/8 or equal to 6.48 mm, in this exampled formulation. As those skilled in the art, other formulations are also possible, and can be adapted where the apex height A is different between the internal structures 120 as well as the internal structure lengths y can be different, such as by pairs of internal structures 120.

FIG. 4 provides a more detailed exemplary illustration of the size, height, length and placement of the internal structures 120 and the recessed surfaces 122 defined there between along the internal surface 118. As shown in this example of FIG. 4, the ring 100 has a center 124 and a second inside diameter 126 (shown also as X) and with a circumference of C and generally an outer diameter 128. In this exemplary embodiment, each of four internal structures 120, shown as internal structures 120A, 120B, 120C, and 120D, are positioned to be centered at a center of each of four graphical quadrants 130, shown as 130A, 130B, 130C, 130D. Generally each of internal structures 120 has maximum height A at the apexes 131 that, in this example, are centered along apex lines 132, shown as 132A, 132B, 132C, 132D, and each of which is centered within each respective quadrant 130. As shown the first internal diameter 125 is defined by the distance between opposing apexes 131 of two opposing internal structures 120, shown in this example as the distance between internal structure 120B and 120C.

As shown in FIG. 4, by way of one example, but is clearly applicable to each internal structure 120, internal structure 120D has an inwardly projecting height of distance A of 134D, that is the distance typically inward from the internal surface 118 as defined by recessed surfaces 122, shown as 122A, 122B, 122C, and 122D, and which define the second internal diameter 126 between opposing recessed surfaces 122. By way of only one example, and not limited thereto, assuming the ring size is size 6 and the height of each internal structure is determined for this ring user to be 0.25 mm, the second inside diameter 126 is 16.51 mm×3.147 equal 51.87 mm. The length of each internal structure can then be 51.87 mm divided by 12 or 4.32 mm. The apex 131 of each internal structure 120 in each quadrant 130 is 51.87 mm divided by 8 or 6.48 mm. With regard to FIG. 4 the inside circumference C and the associated second internal diameter 126, with the internal structure 120 formed thereon for defining the first internal diameter 125 provides for the a reduction in the ring size for each improved ring 100 as compared to that which would have been required by a standard circular interior design ring. Table A illustrates this reduction with reference to the international sizing chart sizes.

Figure 5A:
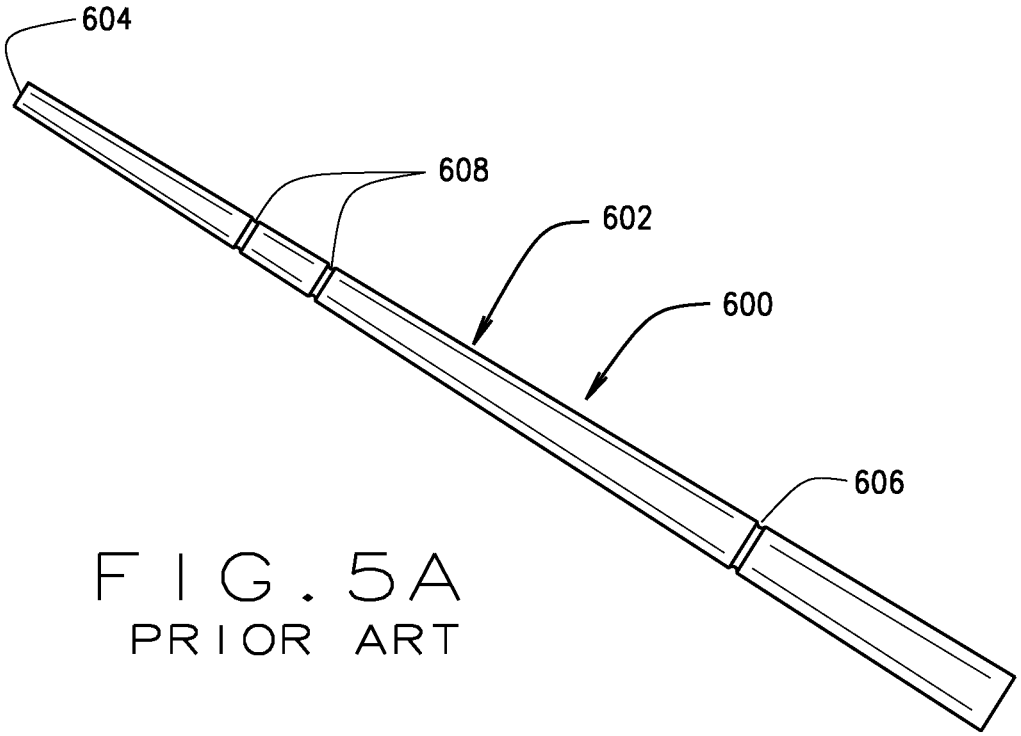
FIG. 5A PRIOR ART
FIGS. 5A and 5B, are top view of a ring sizing mandrel in FIG. 5A and a set of prior art universal ring sizers in FIG. 5B for using to select a ring size for a particular finger of a particular ring wearer, according to the prior art.
Figure 5B:
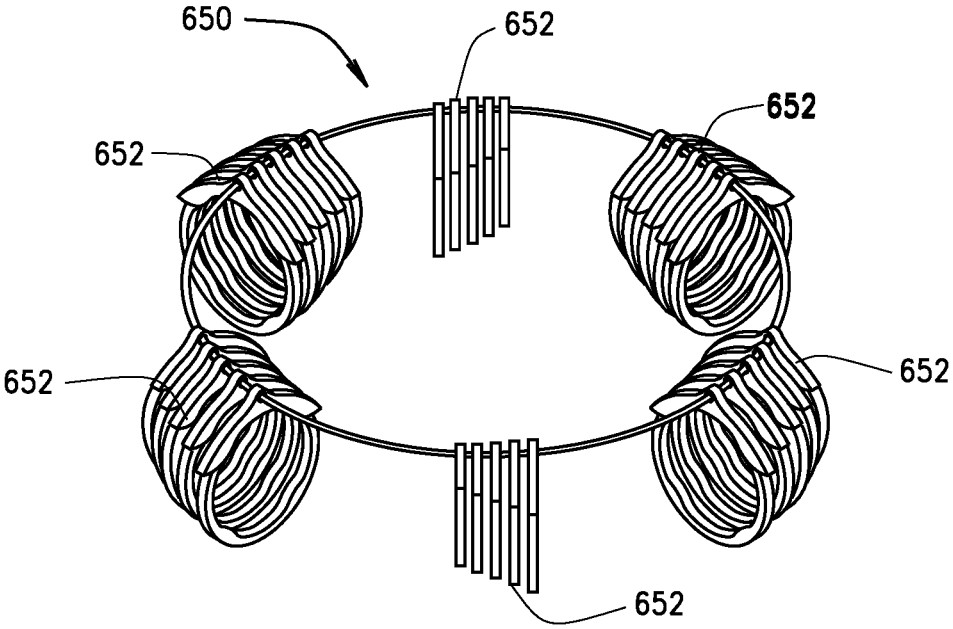
FIG. 5B PRIOR ART

FIG. 5 provides illustrations of prior art sizing tools, that with the new improved ring are not suitable due to the improved ring having the internal structures 120 where two opposing internal structures 120 define a first internal diameter 125 that is less than the second internal diameter 126 that is defined between opposing recessed surfaces 122. FIG. 5A illustrates a side view of a prior art ring sizing mandrel and FIG. 5B illustrates a side view of a set of prior art universal ring sizers as used to select a ring size for a particular appendage of a particular ring wearer, according to the prior art. As shown, the traditional mandrel 600 provides an aid in sizing of a ring has an elongated cylindrical body 602 that is narrow at a top end 604 and widens along its length to a lower end 606. The mandrel 600 includes a plurality of spaced apart gradient markings 608 which include indicia as to the ring size as shown in Table A at various points along the elongated body 602. As noted, the mandrel body 602 is cylindrical and has always been generally round for appropriate sizing of the singular internal diameters of prior art rings. In FIG. 5B, a plurality of ring sizers 650 includes individual ring sizers 652, typically one for each different size of ring. Each of these ring sizers 652 has a round internal surface having a diameter that is equivalent to the ring size as shown in Table A to enable a person to insert their appendage and select a size of a ring based on the fit thereof. Of course, use of the ring sizers 652 illustrates the problem solved by the improved ring 100 as disclosed herein. Each ring sizer 652 has a defined single internal diameter and such diameter must be sufficient for the ring to pass over the knuckle before reaching the back ring bearing portion of the user' s appendage. As such, use of the ring sizers 652 results in the selection of a ring that is based on the size of the knuckle and not on the size of the ring bearing back portion of the appendage, and therefore is oversized.

However, as the anatomically correct improved ring has the internal structures 120 that are raised from the internal surface 118 relative to the adjacent recessed surfaces 122, the second internal diameter defined between two opposing recessed surfaces 122 is greater than the first diameter 125 defined between two opposing internal structures 120. As such, when an anatomically correct improved ring 100 is placed on a tradition mandrel 600 as shown in FIG. 5A, the internal structures 120 will engage with the outer diameter of the mandrel 600, and will result in an improper sizing of the improved ring 100 for the intended appendage, i.e., it will have a larger size that required. In a similar manner, using a traditional ring sizer 652 will result in the user selecting a ring size that is larger than required for wearing the anatomically correct improved ring 100. Both of these will result in a larger than desired ring and will result in the improved ergonomic benefits of the improved ring 100. As such, to address these sizing issues and provide for the correct selection of the sizing for the improved ring 100, a tool for sizing of the anatomically correct improved rings according as described above was developed as shown in FIG. 6, including FIGS. 6A and 6B. As shown in FIG. 6A, a new mandrel 700 has an elongated mandrel body 702 with an upper end 710, a lower end 712 and an optional base 714. The upper end 710 is narrow at the top and widens downward to the base 714 for adapting for the sizing use of various sizes of improved rings 100. However, rather than being round or circular as with all existing prior art mandrels 600, the elongated body 702 has four outward extending portions 706 that are associated with and define the second internal diameter 126 of the improved ring 100 as defined between two opposing recessed surfaces 122, such as 122A and 122D, or 122B and 122D. Between each mandrel extending portion 706, the improved mandrel 700 includes cavities 708 or slots that are configured and/or dimensioned for receiving the inwardly projecting internal structures 120 that are on the internal surface 118 and are spaced apart and between the recessed surfaces 122. In one embodiment, there are four cavities 708 or slots, with the number being equivalent to the number of internal structures 120 of an improved ring 100. In this manner, when using the mandrel 700, an improved ring 100 can be placed over the top end 710 and the internal structures 120 having their length y and their height A are received into the cavities 708, which ensures that that the improved ring 100 is sized to pass over the knuckle but without being oversized for the back ring bearing portion of the appendage. Once over the knuckle, the narrower first internal diameter 125 defined between the opposing internal structures 120 ensures a more anatomically correct fit for the ring 100. With the narrower first internal diameter 125 between the opposing inwardly raised internal structures 120 on the back portion of the ring behind the knuckle, the improved ring 100 is smaller and will be a more accurate fit for that portion of the appendage which will reduce undesired rotation of the ring 100 during use.

Figure 6B:
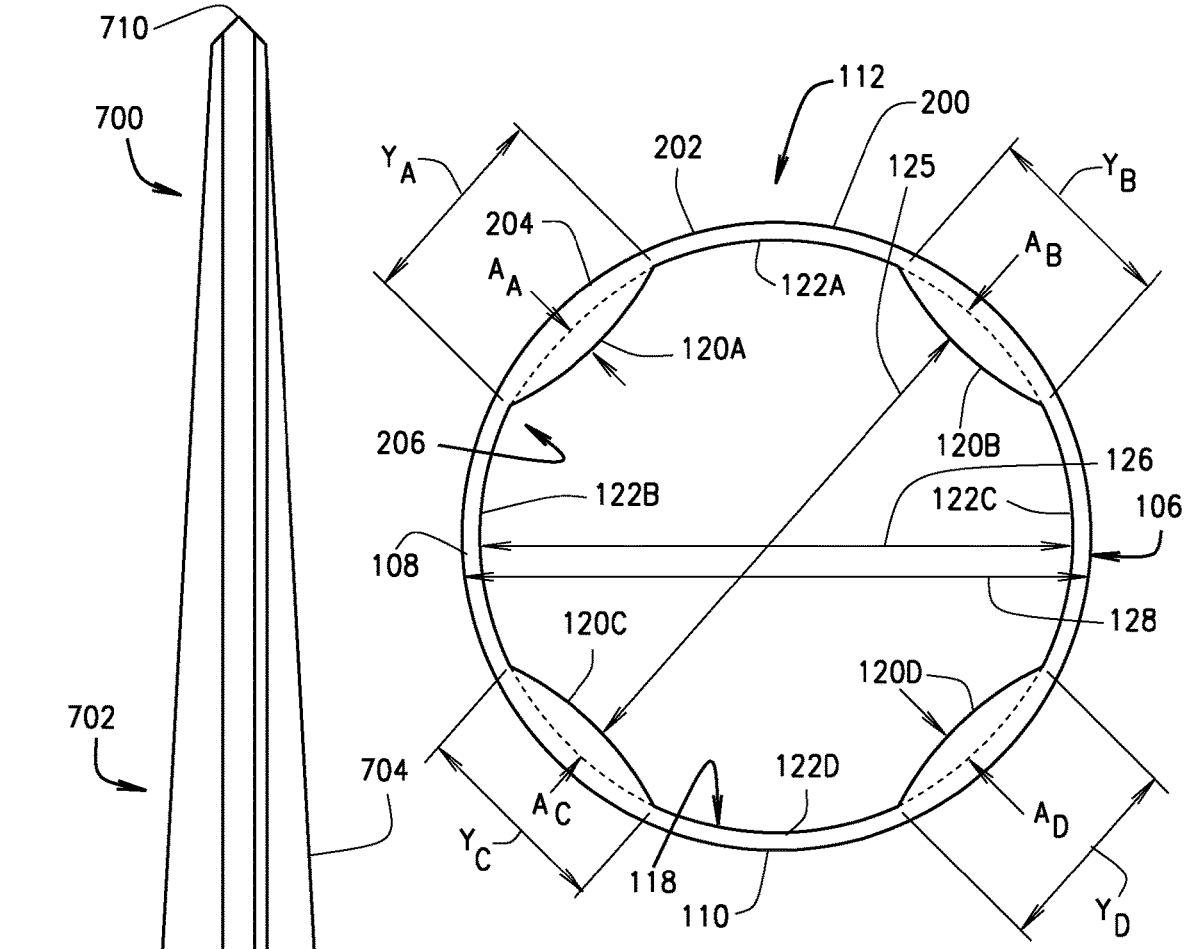
FIG. 6 includes FIG. 6A which is a graphical illustration of an improved anatomically correct ring sizing mandrel and FIG. 6B is a graphical illustration of an improved anatomically correct ring sizer, each according to exemplary embodiments of the present disclosure.
Figure 6A:
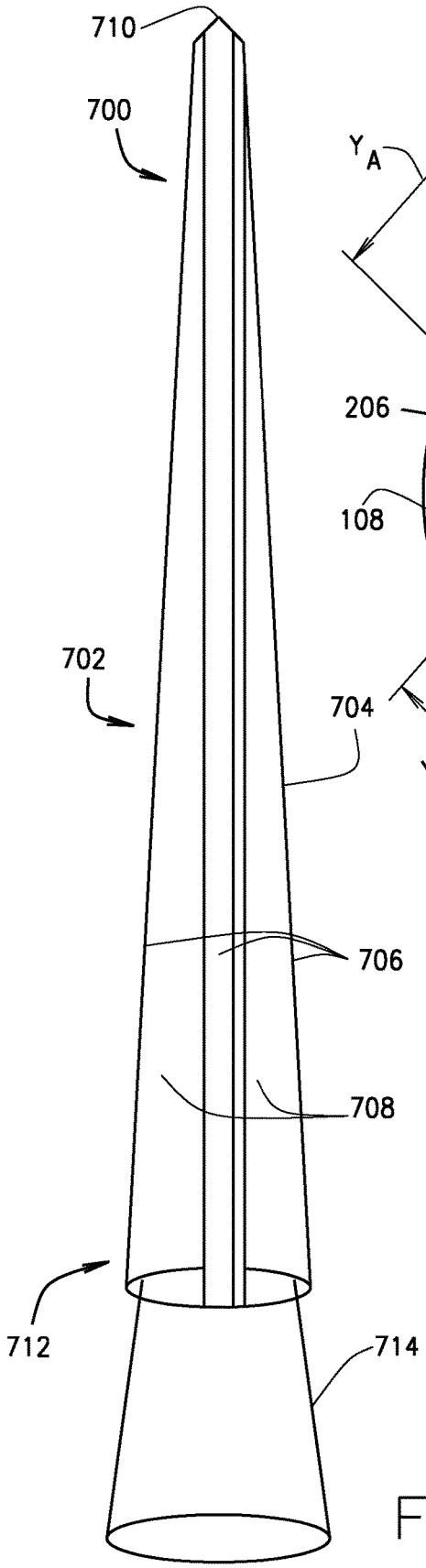

In a similar manner, new ring sizers 200 as illustrated in FIG. 6B have been designed that have the anatomically correct improved ring design with a body 202 having illustrative inwardly raised internal structures 120 with the recessed surfaces 122 positioned between each on the internal surface 206.

The described ring model bodies 52 and the resulting manufactured improved rings 100 can be formed by many different known ring manufacturing processes, so long as the internal surface 118 of each, can be formed such that the internally raised internal structures 120 can be formed to be raised at the appropriate height from the internal surface 118 as defined by the recessed surfaces 122, and at the desired locations and having the desired shape and length. These can include hand-carved wax, cad design and grow wax, die-strike and extruded tubing. By way of just one example, the improved ring 100 can be designed and manufactured using the lost wax investment casting process. This includes the steps of create a ring model (such as illustrated in FIG. 1A, using a melting/burning material such as wax or sometimes certain plastics, either from such material that is hand carved, or more recently by using 3D printing. When using 3D printing, a CAD-CAM design of the ring is created using the 3D computer program which in turn is provided to a 3D wax printer. The 3D design is provided with the dimensions that include the second internal diameters between opposing internal recesses 122 as well as the first internal diameters between opposing internal structures 120 as to their position, height A, length y and shape. The 3D printer then prints, grows or carves the wax to the designed model having dimensions and features of the internal structures 120 and recessed surfaces 122, and the resulting first internal diameter 125 and second internal diameter 126 as described above. The rest of the process is generally the same in that the improved model 50 is then molded or goes through casting wherein the ring model 50 is placed into a heat-resistant cementing material using sprue channels to create a cemented mold having wax ring model 50 therein. Next, the cemented mold is heated so that the wax ring model 50 melts or burns out through the sprue channel leaving a cavity having the form of the wax ring model 50 that includes the recessed surfaces 122 and the internal structures 120. Next the ring metal is placed into the mold usually using pressure such as through injection or extrusion to ensure that the ring metal takes the form of the ring model 50. Then the ring 100 is removed from the mold and the created shape of the improved ring with the non-circular anatomically correct improved internal surface 118 is created. One of ordinary skill in the art will understand that there are other methods of manufacturing rings as described herein and each of such are not repeated herein but are considered to be within the scope of the present disclosure and claimed method of manufacturing.

As the improved rings 100 are configured for improved traversing or placement over the knuckle, the present disclosure includes the improved sizing mandrel and ring sizers that are adapted for sizing of rings having the non-circular shaped interior for aiding in the proper sizing of the improved ring 100 for each appendage.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

TABLE 1

Anatomically Correct Improved Ring Sizing Chart
Anatomically Correct Improved Ring Sizing Chart
(Chart resouces modified from International ring size conversion chart)

| | | | | | | Apprx Chg Ring Size Due to Arch Height | | |
|---|---|---|---|---|---|---|---|---|
| Inside Diameter = X MM | Inside Cicumference = C MM | Ring Size | Inside Diameter = X MM | Inside Cicumference = C MM | Ring Size | Apex of same size arches 0.25 mm .25 × 4 = 1.00 | Apex of same size arches 0.5 mnm .5 × 4 = 2 | Apex of same size arches 0.75 mm .75 × 4 = 3 |
| 12.37 | 38.86 | 1 | 17.97 | 56.45 | 7.75 | −0.5 | −0.75 | −1.25 |
| 12.6 | 39.58 | 1.25 | 18.19 | 57.15 | 8 | | | |
| 12.78 | 40.15 | 1.5 | 18.35 | 57.65 | 8.25 | | | |
| 13 | 40.84 | 1.75 | 18.53 | 58.21 | 8.5 | | | |
| 13.21 | 41.5 | 2 | 18.61 | 58.47 | 8.625 | | | |

TABLE 1-continued

Anatomically Correct Improved Ring Sizing Chart
Anatomically Correct Improved Ring Sizing Chart
(Chart resouces modified from International ring size conversion chart)

| | | | | | | Apprx Chg Ring Size Due to Arch Height | | |
|---|---|---|---|---|---|---|---|---|
| Inside Diameter = X MM | Inside Cicumference = C MM | Ring Size | Inside Diameter = X MM | Inside Cicumference = C MM | Ring Size | Apex of same size arches 0.25 mm .25 × 4 = 1.00 | Apex of same size arches 0.5 mnm .5 × 4 = 2 | Apex of same size arches 0.75 mm .75 × 4 = 3 |
| 13.41 | 42.13 | 2.25 | 18.69 | 58.72 | 8.75 | | | |
| 13.61 | 42.76 | 2.5 | 18.8 | 59.06 | 8.875 | | | |
| 13.83 | 43.45 | 2.75 | 18.89 | 59.34 | 9 | | | |
| 14.05 | 44.14 | 3 | 19.1 | 60 | 9.125 | | | |
| 14.15 | 44.45 | 3.125 | 19.22 | 60.38 | 9.25 | | | |
| 14.25 | 44.77 | 3.25 | 19.31 | 60.66 | 9.375 | | | |
| 14.36 | 45.11 | 3.375 | 19.41 | 60.98 | 9.5 | | | |
| 14.45 | 45.4 | 3.5 | 19.51 | 61.29 | 9.625 | | | |
| 14.56 | 45.74 | 3.625 | 19.62 | 61.64 | 9.75 | | | |
| 14.65 | 46.02 | 3.75 | 19.84 | 62.33 | 10 | | | |
| 14.86 | 46.68 | 4 | 20.02 | 62.89 | 10.25 | | | |
| 15.04 | 47.25 | 4.25 | 20.2 | 63.46 | 10.5 | | | |
| 15.27 | 47.97 | 4.5 | 20.32 | 63.84 | 10.625 | | | |
| 15.4 | 48.38 | 4.625 | 20.44 | 64.21 | 10.75 | | | |
| 15.53 | 48.79 | 4.75 | 20.68 | 64.97 | 11 | | | |
| 15.7 | 49.32 | 5 | 20.76 | 65.22 | 11.125 | | | |
| 15.8 | 49.64 | 5.125 | 20.85 | 65.5 | 11.25 | | | |
| 15.9 | 49.95 | 5.25 | 20.94 | 65.78 | 11.375 | | | |
| 16 | 50.27 | 5.375 | 21.08 | 66.22 | 11.5 | | | |
| 16.1 | 50.58 | 5.5 | 21.18 | 66.54 | 11.625 | | | |
| 16.3 | 51.21 | 5.75 | 21.24 | 66.73 | 11.75 | | | |
| 16.41 | 51.55 | 5.875 | 21.3 | 66.92 | 11.875 | | | |
| 16.51 | 51.87 | 6 | 21.49 | 67.51 | 12 | | | |
| 16.71 | 52.5 | 6.25 | 21.69 | 68.14 | 12.25 | | | |
| 16.92 | 53.16 | 6.5 | 21.89 | 68.77 | 12.5 | | | |
| 17.13 | 53.82 | 6.75 | 22.1 | 69.43 | 12.75 | | | |
| 17.35 | 54.51 | 7 | 22.33 | 70.15 | 13 | | | |
| 17.45 | 54.82 | 7.25 | 22.6 | 71 | 13.5 | | | |
| 17.75 | 55.76 | 7.5 | | | | | | |

What is claimed is:

1. A jewelry ring comprising:

a main body having an outer shape with an outer surface defining an outer perimeter including a top, a bottom and two opposing sides, an internal surface wall defining an orifice having a center, the orifice being configured for receiving an appendage of a wearer, and having a defined width from a first side to a second side, the main body further having a top wherein the outer surface of the top is configured for receiving or mounting of a jewelry fixture, a bottom that is on the opposing side of the main body from the top outer surface and a right side and left side; and a plurality of spaced apart internal structures on the internal surface wall that inwardly project with each adjacent pair of internal structures defining a recessed surface there between, each inwardly projecting internal structure having an internal structure surface and an internal structure height of inward projection from the adjacent recessed surface and defining a first internal diameter and each having an internal structure length along the internal perimeter surface wall defining the recessed surface, each of the plurality of recessed surfaces between the internal structures defining a second internal diameter that is greater than the first internal diameter;

wherein at least two of the plurality of internal structures have different internal structure heights.

2. The jewelry ring of claim 1 wherein there are four internal structures formed on the internal surface wall, and each is spaced apart by one of four recessed surfaces of the internal surface wall.

3. The jewelry ring of claim 2 wherein the four internal structures are positioned approximately equal distance apart from each other.

4. The jewelry ring of claim 2 wherein the four internal structures including two pairs of internal structures with each pair being positioned opposite an opposing pair mate.

5. The jewelry ring of claim 2 wherein the top of the ring defines a center line from the top through the center of the orifice and wherein two of the four internal structures have a maximum height positioned on the internal surface at about 45 degrees on either side of the center line, and the other two internal structures are positioned at about 135 degrees from each side of the center line.

6. The jewelry ring of claim 2 wherein each of the plurality of internal structures has the same internal structure height.

7. The jewelry ring of claim 2 wherein each of the plurality of internal structures has an internal structure height of about 0.25 mm.

8. The jewelry ring of claim 2 wherein each of the plurality of internal structures has an internal structure height of between about 0.10 mm to about 0.5 mm.

9. The jewelry ring of claim 1 wherein one or more of the internal structures have an internal structure height of about 0.25 mm.

10. The jewelry ring of claim 1 wherein each of the plurality of internal structures has an internal structure height of between about 0.10 mm to about 0.5 mm.

11. The jewelry ring of claim 1 wherein each internal structure has a substantially arch shape having each end extending from an opposing adjacent recessed surface to the internal structure height at an apex of the arch.

12. The jewelry ring of claim 11 wherein each arch shaped internal structure has an elongated arch shape.

13. The jewelry ring of claim 1 wherein each internal structure has a substantially elongated shape with rounded ends.

14. The jewelry ring of claim 1 wherein the each of the plurality of internal structures is positioned approximately equal distance apart from another of the plurality of internal structures.

15. The jewelry ring of claim 1 wherein there is an even number of plurality of internal structures and each two of the internal structures are a pair mate with each of the internal structures in each pair mate being opposite of the pair mate.

16. The jewelry ring of claim 1 wherein the top of the ring defines a center line from the top through the center of the orifice and wherein at least two of the plurality of internal structures have a maximum height positioned on the internal surface at about 45 degrees on either side of the center line.

17. The jewelry ring of claim 1 wherein each of the plurality of internal structures are integrally formed with as a monolithic structure with the main body of the ring.

18. The jewelry ring of claim 1 wherein the outer surface of the main body is configured for receiving a jewelry fixture.

19. The jewelry ring of claim 18 wherein the top of the outer surface of the main body is configured for receiving a jewelry fixture.

20. The jewelry ring of claim 1 wherein the main body of the ring has a substantially round outer shape defined by the outer surface thereof.

21. A method of manufacturing an anatomically correct jewelry ring comprising:

forming a main body having an outer shape with an outer surface defining an outer perimeter including a top, a bottom and two opposing sides, an internal surface wall defining an orifice having a center, the orifice being formed for receiving an appendage of a wearer, and having a defined width from a first side to a second side, the main body further having a top wherein the outer surface of the top is configured for receiving or mounting of a jewelry fixture, a bottom that is on the opposing side of the main body from the top outer surface and a right side and left side;

determining a plurality of spaced apart internal structures to be formed on the internal surface wall that project inwardly therefrom, the determining of each internal structure including determining an internal structure surface and an internal structure height of an inward projection from the internal surface and defining a first internal diameter and defining an internal structure length along the internal surface wall, wherein the determining includes determining the first internal diameter as a distance required for the ring to pass over a knuckle of the appendage, determining the internal structure height from the determined first internal diameter, determining a length for each internal structure wherein the forming includes forming the plurality of internal structures using the determined lengths of each internal structure, and wherein determining the first internal diameter includes using a mandrel having a tapered elongated body with an outer surface having a plurality of different scaled diameters along the length of the elongated body and having a plurality of spaced apart longitudinal internal cavities formed thereon, the longitudinal cavities being used for receiving inwardly projecting internal structures of a ring placed on the mandrel with the recessed portions of the internal surface contacting the outer surface of the mandrel;

forming the determined plurality of spaced apart internal structures on the internal surface wall that project inwardly therefrom, the forming of each internal structure including forming the determined internal structure surface and the determined internal structure height of the inward projection from the internal surface and forming the first internal diameter and each having the determined internal structure length along the internal surface wall; and forming between each adjacent pair of internal structures a recessed surface, each of the plurality of recessed surfaces between the internal structures being formed to define a second internal diameter that is greater than the first internal diameter.

22. The method of claim 21 wherein determining the first internal diameter includes using a ring sizer shaped with internal structures that project inwardly from an internal surface of the ring sizer and that has two different internal diameters, a first internal diameter defined between opposing internal structures and a second internal diameter that is greater than the first internal diameter.

* * * * *